United States Patent [19]

Jeanneret et al.

[11] 4,191,566

[45] Mar. 4, 1980

[54] ELECTROPHOTOGRAPHIC IMAGING PROCESS USING ANTHRAQUINOID BLACK PIGMENTS OR METAL COMPLEXES

[75] Inventors: Rémy Jeanneret, Allschwil; Günther Zwahlen, Dornach; Christoph Frey, Aesch; Georgios Zographos, Buchs, all of Switzerland

[73] Assignee: Ciba-Geigy Corporation, Ardsley, N.Y.

[21] Appl. No.: 873,818

[22] Filed: Jan. 31, 1978

[30] Foreign Application Priority Data

Feb. 7, 1977 [CH] Switzerland ..... 1456/77

[51] Int. Cl.[2] ..... G03G 13/056

[52] U.S. Cl. ..... 430/37

[58] Field of Search ..... 96/1 M, 1 PS, 1 PC, 96/1.1, 1, 1.5; 252/62.1 L

[56] References Cited

U.S. PATENT DOCUMENTS

| | | | |
|---|---|---|---|
| 3,384,566 | 5/1968 | Clark | 96/1 PE X |
| 3,560,360 | 2/1971 | Carreira et al. | 204/181 |

FOREIGN PATENT DOCUMENTS 1418292 12/1975 United Kingdom .

*Primary Examiner*—John D. Welsh

*Attorney, Agent, or Firm*—Joseph F. DiPrima

[57] ABSTRACT

An electrophotographic imaging process, wherein the electrically photosensitive particles for the image reproduction consist of a black pigment selected from the series of the anthraquinoid pigments which contain at least 2 anthraquinone radicals or at least 6 condensed rings, of the perylenetetracarboxylic diimides or of the metal complexes of the formula wherein A represents a nitrogen atom or the X represents a hydrogen or halogen atom or an alkyl group of 1 to 6 carbon atoms, Y represents a hydrogen or halogen atom, an alkyl, alkoxy or alkylsulphonyl group of 1 to 6 carbon atoms, a nitro or carbamoyl group, an alkylcarbamoyl or alkoxycarbonyl group of 2 to 6 carbon atoms or an arylcarbamoyl or aryloxycarbonyl group of 7 to 11 carbon atoms.

4 Claims, 1 Drawing Figure

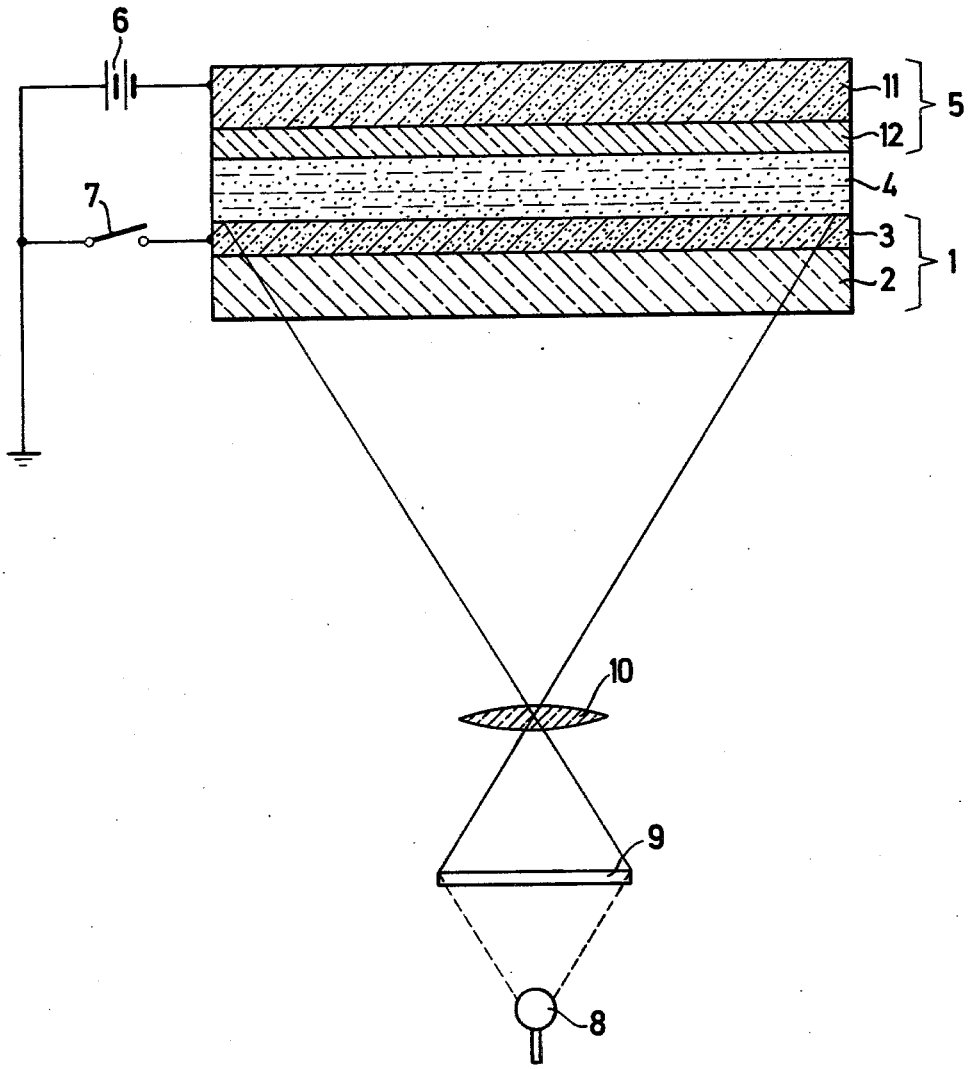
6
7
11
12
5
4
3
2
1
10
9
8

ELECTROPHOTOGRAPHIC IMAGING PROCESS USING ANTHRAQUINOID BLACK PIGMENTS OR METAL COMPLEXES

Among the electrophotographic image reproduction processes there are those which of necessity use electrically photosensitive particles for the image formation. In other processes, the use of electrically photosensitive particles for image reproduction is not necessary, but yet advantageous. In the electrostatic processes, it is necessary to use a recording material provided with an electrically photosensitive layer. The present invention has for its object to provide electrically photosensitive, organic black pigments for all these processes.

The imaging processes in which of necessity electrically photosensitive particles are used for the image formation, are based on the interaction of electromagnetic radiation with suitable electrically photosensitive particles which are dispersed in an insulating medium. If, for example, a suspension of these particles is brought in the form of a thin layer into an electric field, which is produced for example by a plate capacitor, and if the layer is imagewise exposed, then the exposed and unexposed electrically photosensitive particles move in opposite directions, i.e. an imagewise separation of the particles takes place. A positive and a negative copy respectively of the original image is formed on the opposite surfaces of the electrodes. This effect forms the basis of image reproduction with electrically photosensitive particles.

Of the large number of patent specifications which describe such processes, a number are discussed below.

A dry process is described in U.S. Pat. No. 2,758,939. In this process, a charge exchange takes place at the exposed areas between the electrically photosensitive particles and an electrode.

In U.S. Pat. Nos. 2,940,847, 3,384,565, 3,384,566, 3,384,488 and 3,383,993, the electrically photosensitive particles are suspended in an insulating liquid and a "photoelectrophoretic imaging process" is described. In this process, it is also assumed that a charge exchange takes place at the exposed areas between the electrically photosensitive particles and an electrode ("injection electrode").

German Offenlegungsschrift No. 2,356,687 discloses a photoelectrophoretic imaging process in which a charge exchange takes place at the exposed areas between the electrically photosensitive particles and the liquid surrounding them.

German Offenlegungsschrift No. 2,459,078 describes a photoelectrophoretic imaging process in which the charge exchange takes place at the unexposed areas between the electrically photosensitive particles and an electrode which carries a homogeneous layer containing or consisting of a dark charge exchange material. The applicant calls this process a "photoimmobilised electrophoretic recording process".

In addition, there are a large number of photoelectrophoretic imaging processes, of which only a few are discussed here. U.S. Pat. No. 3,870,517 and German Offenlegungsschrift No. 2,047,099 disclose processes in which the electrically photosensitive particles are suspended in a "white colored opaque" medium or in a coloured medium. By means of photoelectrophoresis, the optical reflectance properties of the suspension layer are changed according to the radiation image. These processes are suitable less for producing a hard copy but much more for producing a soft copy or display. German Offenlegungsschrift No. 2,331,833 discloses a photoelectrophoretic process in which the exposure is effected through a partly transparent sheet of paper which lies between the injection electrode and the suspension. In German Offenlegungsschrift No. 2,028,364, an electrode is replaced by an electrostatic charge.

In the "migration imaging process" described for example in U.S. Pat. No. 3,520,681, the electrically photosensitive particles are finely distributed in a solid, but softenable or soluble matrix. In order to make possible the imagewise migration of the particles, the substance is softened or dissolved by heat, treatment with solvents in fluid or vapour form, by a combination of these means or by other means, before, during or after the exposure. A very good survey of the migration processes is to be found in the periodical "Bild und Ton", 28, Fasc. 5, page 135 (1975).

A further imaging process, described for example in U.S. Pat. No. 3,707,368 and which also of necessity uses electrically photosensitive particles, is the "manifold imaging process", in which the imaging layer is sandwiched between a donor and a receiving sheet.

A further process to be mentioned is that described for example in German Offenlegungsschrift No. 1,472,906, wherein an earthed, uncharged "image carrier" is dusted with an electrically photosensitive "colour carrier" powder which is electrostatically charged before or after the dusting. After imagewise exposure the less firmly adhering particles (at the exposed areas) are removed, whilst the more firmly adhering ones are fixed.

All these processes, which of necessity use electrically photosensitive particles for the image reproduction, are suitable for producing both monochrome and polychromatic line and continuous tone images. In the case of monochrome images, it will be appreciated that black and white images are of especial interest. This means, however, that black, electrically photosensitive particles must be available. To the skilled person it is obvious that, in this connection, it is most advantageous to use pigments—i.e. single component particles—which are both chromophoric and electrically photosensitive. As against this, composite particles, i.e. multicomponent particles, have distinct disadvantages. However, the search for organic pigments which are both black and sufficiently electrically photosensitive for image reproduction has up to now been unsuccessful. In a number of patent specifications, the problem of producing black and white images by those processes which, of necessity, use electrically photosensitive particles, has been solved by using composite particles or by another roundabout route: In German Offenlegungsschrift No. 2,048,380, for example, composite particles are used which consist of a polymer matrix into which at least two differently coloured and electrically photosensitive pigments are incorporated. In German Offenlegungsschrift No. 2,256,329, very similar particles are used in which at least one of the pigments or the polymer matrix is electrically photosensitive. By using suitably chosen pigments, for example cyan, magenta and yellow, an attempt is made to obtain a black toner. However, it is obvious to the skilled person that no deep black can thereby be attained. Composite particles are also used especially for the photoelectrophoretic process in German Offenlegungsschrift No. 2,050,068. These particles are suitably coloured resin particles to which very finely divided electrically photosensitive pigment particles adhere. For black, there are used resin particles pigmented with carbon black to which phthalocyanine particles as electrically photosensitive component adhere. Yet another means of producing black and white images by the photoelectrophoretic imaging process is employed in German Offenlegungsschrift No. 2,400,185. In this process, zinc oxide particles, which are electrically photosensitive but not coloured, migrate to an image-receiving sheet which carries a layer of a vinylidene/acrylonitrile copolymer. Since this copolymer is colourless, a white-in-white image is initially formed. On heating the image-receiving sheet, the image then becomes brown or black as a consequence of the decomposition and carbonisation of the copolymer in contact with the zinc oxide. It is perfectly obvious to the skilled person what the drawbacks of the processes just referred to for producing black and white images are: for example the complicated and uneconomic production of such composite particles, poor photosensitivity, inadequate colour strength and poor image quality.

There are in addition a substantial number of electrophotographic imaging processes, viz. the highly successful electrostatic processes employed for many years in the office copying sector (for example the Xerox, electrofax, TESI process, both with dry and wet development of the electrostatic image) and which use—even if not of necessity, yet with advantage—electrically photosensitive particles as toner particles for the image development. For example, in German Offenlegungsschrift No. 2,256,329, attention is drawn on page 38 to the advantages possessed by electrically photosensitive toners in such processes. Owing to the electrical photosensitivity, the charging rate and charge disintegration of the toners can be regulated. Moreover, the image developed with an electrically photosensitive toner can be exposed, whereby its conductivity and thus its charge can be regulated in order to improve the image transfer, if necessary. In addition, exposure can be effected after the transfer in order to reduce the charges on the residual toner particles, thereby increasing the cleansing effect.

The use of black, electrically photosensitive pigments is also advantageous for the production of polychromatic images, namely where the contrast effect of polychromatic photocopies is to be increased with black. In the production of a polychromatic image, a number of colour selection copies are superimposed, for example in the order black, yellow, magenta, cyan. Because of the necessity to recharge the photoconductor used as electrophotographic recording material repeatedly, namely after the deposit of each partial image, and to expose it imagewise, the use of electrically photosensitive toners for developing the partial images is advantageous. In German Auslegeschrift No. 2,006,003, the proposal has been made to use photoconductor particles coloured with pigments or dyes, i.e. multicomponent particles, as toner particles. Attention has already been drawn to the disadvantages of such multicomponent particles.

As is commonly known, a recording material having an electrically photosensitive layer is used in the electrostatic processes. For the production of this recording material an electrically photosensitive substance is required. The electrically photosensitive substances hitherto known and used for this purpose, for example selenium, zinc oxide, cadmium sulphide, phthalocyanine pigments etc., have various disadvantages. An important drawback of these materials is that they are not panchromatic. Consequently, a spectral sensitisation is necessary for practical purposes. However, every skilled person knows what difficulties such a procedure entails. In contradistinction thereto, the black pigments of the present invention possess panchromatic properties, so that a spectral sensitisation is unnecessary. The black pigments of the present invention can be used in different weight ratios with any binders, i.e. both with "active" and with "insulating", or with photoconductive or non-photoconductive, binders. The resulting recording materials can be charged both negatively and positively, which is also advantageous. Furthermore, the ratio of pigment to binder can be kept relatively low, so that the mechanical properties of the recording material are determined largely by the properties of the binder. Since, as already mentioned, the binders can be very freely chosen, there are many ways in which the recording materials can be obtained.

It has been found that in both the above mentioned electrophotographic processes which of necessity, and those which advantageously, use electrically photosensitive particles, and that in producing an electrophotographic recording material, surprisingly excellent results are obtained by using, as electrically photosensitive material, a black pigment selected from the series of the anthraquinoid pigments which contain at least 2 anthraquinone radicals or at least 6 condensed rings, of the perylenetetracarboxylic diimides or of the metal complexes of the formula (I)

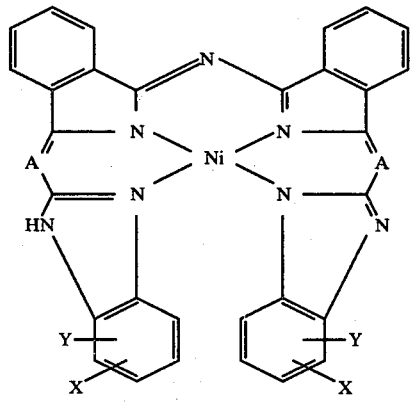

wherein

A represents a nitrogen atom or the

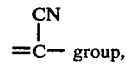

X represents a hydrogen or halogen atom or an alkyl group of 1 to 6 carbon atoms, Y represents a hydrogen or halogen atom, an alkyl, alkoxy or alkylsulphonyl group of 1 to 6 carbon atoms, a nitro or carbamoyl group, an alkylcarbamoyl or alkoxycarbonyl group of 2 to 6 carbon atoms or an arylcarbamoyl or aryloxycarbonyl group of 7 to 11 carbon atoms.

Examples of anthraquinoid black pigments are especially the pigment of the formula (II)

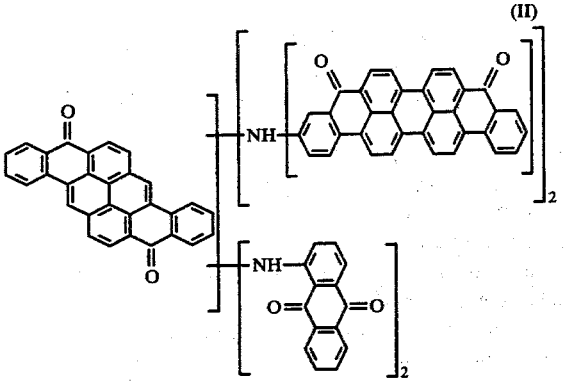

listed as Vat Black 9 in the Color Index, 3rd edition, the polyanthrimide listed as Vat Black 30 in the Color Index, 3rd edition, as well as the pigment of the formula (III)

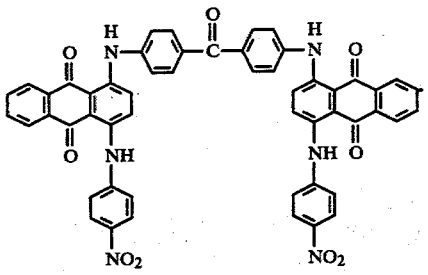

and the derivatives of dibenzanthrone listed as Vat Green 9 and Vat Black 7 in the Color Index, 3rd edition. The pigment of the formula (III) can be obtained by the process described in Example 138 of British patent specification No. 1,415,037 by condensation of 1 mole of 4,4'-dibromobenzophenone with 2 moles of 1-amino-4-p-nitrophenylamino-anthraquinone.

As black pigments of the perylenetetracarboxylic diimide series there may be mentioned in particular those of the formula (IV)

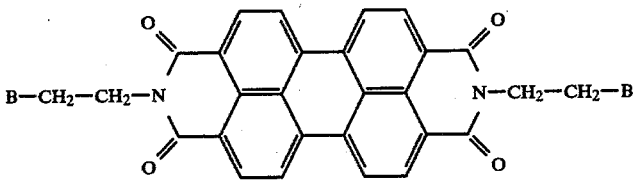

wherein B represents a methyl, hydroxymethyl or phenyl group, the manufacture of which is described in German Offenlegungsschrift No. 2,451,780 and 2,451,783.

Examples of metal complexes are those of the formula (V)

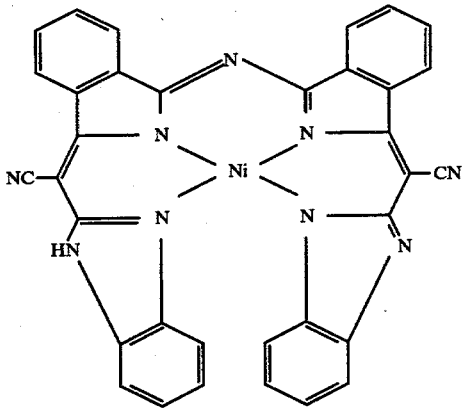

and (VI)

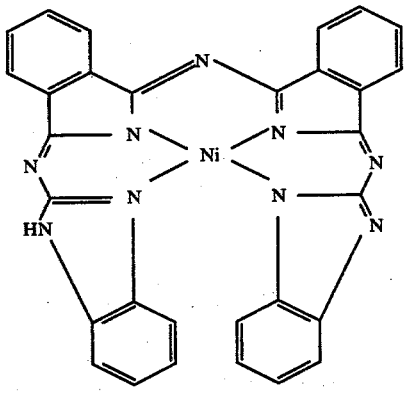

These are new compounds, the manufacture of which is described in Examples 11 and 12 of this specification.

The pigments are advantageously in finely divided form. It will be understood that, instead of the individual pigments, it is also possible to use mixtures of these pigments with one another or with other pigments, or to use them in the form of suitable liquid or solid preparations, for example in combination with polymeric carriers.

The use of the pigments of the present invention in imaging processes in which electrically photosensitive particles are necessary, is described below in more detail with reference to the enclosed drawing, which shows an example of such a process.

The FIGURE shows a transparent electrode 1, which in this case consists of optically transparent glass 2 coated with a thin, optically transparent layer 3 of tin oxide. This material is available under the registered trademark "NESA Glass". The surface of this electrode 1 is coated with a thin layer 4 of fine-grained, electrically photosensitive particles, dispersed in an insulating medium (e.g. carrier liquid). This layer is designated hereinafter as electrically photosensitive layer. The electrically photosensitive layer 4 can contain in addition a sensitising agent and/or a binder for the pigment particles. Contiguous to the electrically photo-sensitive layer is a second electrode 5. This electrode is connected to one side of the voltage source 6. The opposite side of the voltage source 6 is connected via a switching means 7 to the electrode 1, so that if the switching means 7 is closed, an electric field is applied between the electrodes 1 and 5 across the layer 4. A projector consisting of a light source 8, a slide 9 and a lense 10 irradiates the layer 4 with an image of the slide 9 to be reproduced. The layer 4 is thus irradiated with the image to be reproduced, whilst a voltage is applied between the electrodes 1 and 5 by closing the switching means 7. The irradiation causes for example the exposed pigment particles to be activated, so that a pigment image which is a duplicate of the slide 9 is formed on the surface of one of the electrodes. In the case of photoelectrophoresis (liquid medium), the relatively volatile carrier liquid evaporates after the irradiation, and the pigment image remains. This pigment image can subsequently be fixed, for example by applying a coating layer to the surface of the image or with a dissolved binder in the carrier liquid, for example paraffin wax. Approximately 3 to 6% by weight of the paraffin binder in the carrier gives good results. The carrier liquid itself can be a liquid paraffin wax or another suitable binder. According to an other embodiment, the pigment image remaining on the electrode 1 or 5 can be transferred to another surface and fixed thereon. Any suitable insulating medium can be used as carrier for the pigment particles in the system. Typical media are decane, dodecane, n-tetradecane, paraffin, beeswax or other thermoplastic materials, Sohio Odorless Solvent 3440 (a kerosene fraction available from the Standard Oil Company) and Isopar G (a branched-chain, saturated aliphatic hydrocarbon available from Esso Standard). Good quality images are obtained at voltages between 200 and 5000 volts which are applied using the device illustrated in the figure. The amount of pigment in the carrier liquid is advantageously 0.5 to 10%. The addition of smaller amounts, for example 0.5 to 5 mole percent of selected electron donors or acceptors to the surface either of the pigment or one of the electrodes or in the suspension, can result in a marked improvement for example of the light sensitivity of the system.

The Examples illustrate the invention with respect to the photoelectrophoretic imaging process, the migration process, and the electrophotographic recording material, but imply no restriction thereto. The parts are by weight.

Examples 1–10 relate to the photoelectrophoretic process and are carried out in a device corresponding to the type illustrated in the accompanying figure. The imaging suspension 4 is applied between the two electrodes 1 and 5. The irradiation is effected through the transparent electrode 1. The NESA glass surface is connected in series with a switching means 7, a voltage source 6 and the conductive part 11 of a counterelectrode 5 which can be provided with a surface coating 12 of, for example, barytes paper. The plates used have a size of about 10 $cm^2$. The light intensity is between 1000 and 8000 lux, measured on the non-coated NESA glass surface. The amount of the voltage is between 200 and 1000 volts. The irradiation is carried out with a 3200° K-lamp through a black and white image. A space of 0.1 mm is chosen between the electrodes 1 and 5.

EXAMPLE 1

6 parts of the pigment of the formula (II) are ground in a laboratory sand mill in 94 parts of Isopar G until a fine state of division is attained. The resulting suspension, diluted in the ratio 1 to 5 with further Isopar G, is applied as electrically photosensitive layer between the two electrodes. An image is produced by proceeding as described hereinbefore. Good copies of the original are obtained at an illumination intensity of about 5500 lux, measured on the tin oxide/glass surface without pigment suspension and a voltage of −700 volts. A positive copy of the original forms on the tin oxide/glass electrode and a negative copy on the counterelectrode.

EXAMPLES 2–10

Column 2 of Table 1 lists further pigments which were used for image reproduction by the process described in Example 1.

Table 1

| Example | Black pigment | for image reproduction illumination intensity (lux) | applied voltage (volts) |
|---|---|---|---|
| 2 | C.I. Vat Black 30 | 8000 | − 700 |
| 3 | of the formula (III) | 5500 | − 700 |
| 4 | C.I. Vat Green 9 | 8000 | − 700 |
| 5 | C.I. Vat Black 7 | 5000 | − 450 |
| 6 | of the formula (IV), $B=CH_3$ | 3500 | − 200 or − 400 |
| 7 | of the formula (IV), $B=CH_2—OH$ | 3700 | − 400 |
| 8 | of the formula (IV), $B=C_6H_5$ | 1200 | − 700 |
| 9 | of the formula (V) | 3000 | − 700 |
| 10 | of the formula (VI) | 1200 | − 700 |

EXAMPLE 11

With stirring, 28,5 parts of the condensation product of 2-cyanomethylbenzimidazole and 1-amino-3-imino-isoindolenine of the formula

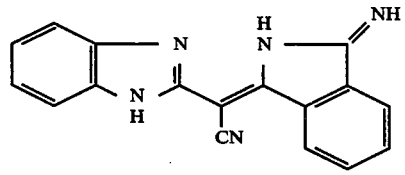

are kept for 15 hours at 140°–145° C. in 700 parts of diethylene glycol monoethyl ether with 9.7 parts of anhydrous nickel acetate. The temperature is then allowed to fall to 130° C. and the black precipitate is collected by filtration, washed thoroughly with methanol and hot water and dried in vacuo at 100° C. affording 22.2 parts of a black crystalline powder of the formula (V).

EXAMPLE 12

35 parts of the condensation product of 2-aminobenzimidazole and 1-amino-3-imino-isoindolenine of the formula

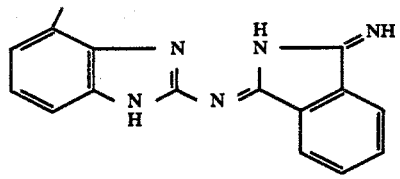

are stirred for 15 hours at 115°-120° C. in 500 parts of diethylene glycol monoethyl ester with 13 parts of nickel acetate (anhydrous). The precipitate is filtered off hot, washed with methanol and hot water and dried at 100° C. in vacuo, affording 25.8 parts of a black powder of the formula (VI).

Examples 13 to 17 relate to the migration process.

EXAMPLE 13

1 part of the pigment of the formula (V) is a ground in a solution of 9 parts of Piccotex 100 (a copolymer based chiefly on vinyl toluene, available from Hercules) in 10 parts of toluene in a laboratory sand mill until a fine state of division is attained. The resulting suspension is coated on an aluminium sheet using a film drawing rod (wet film thickness 24 micrometers). After evaporation of the solvent, the layer is brought with a corona charging unit to a negative potential of about 240 volts and then exposed imagewise with white light and an illumination intensity of 450 lux. For development, i.e. softening of the layer, the exposed layer is immersed for a few seconds in cyclohexane. A good quality duplicate of the original remains on the aluminium sheet. The resolution is good and the optical density high.

EXAMPLES 14-17

The procedure of Example 13 is repeated with the sole difference that another pigment is used instead of the pigment of the formula (V). The results are reported in Table 2.

Table 2

| Ex. | Black pigment | Image quality | Resolution | Optical density |
|---|---|---|---|---|
| 14 | of the formula (VI) | good | good | high |
| 15 | of the formula (IV), B = $CH_3$ | good | good | high |
| 16 | of the formula (IV), B = $CH_2OH$ | good | good | high |
| 17 | of the formula (IV), B = $C_6H_5$ | good | good | high |

Using another film drawing rod, a wet film thickness of 12 micrometers can also be obtained with similarly good results but with the difference that, as is to be expected, the optical density is less high.

Examples 18 to 53 relate to use of the pigments of the present invention for obtaining electrophotographic recording materials.

EXAMPLE 18

A suspension consisting of 1 part of the pigment C. I. Vat Black 7 in a solution of 15 parts of polyvinyl carbazole (available from BASF under the registered trademark "Luvican M 170") in 184 parts of chlorobenzene is ground in a laboratory sand mill until a fine state of division is attained. An aluminium sheet is coated with the resulting suspension using a film drawing rod (wet film thickness of about 60 micrometers). After the coating has dried, a layer is obtained which is tested as recording material with the "Dyntest-90" measuring device (available from ECE, Giessen, West Germany) which is very suitable for electrostatic sensitometry. The characteristic values measured are: $V_S$=surface potential in volts directly before the exposure, $\Delta V_D$=drop of potential in the dark in volts per second, and $\Delta V_{Ph}$=initial drop in potential on exposure in volts per second. As is generally known, the sensitivity E in volts per lux second is calculated from $\Delta_{Ph}$. The exposure is effected with white light and an illumination intensity of 35 lux.

The following values are obtained with negative charging: $V_S$=−215 V, $\Delta V_D$=3.0 V/s, $\Delta V_{Ph}$=107 V/s and E=3.1 V/lx s.

EXAMPLE 19

The procedure of Example 18 is repeated with the difference that the recording material is positively charged. The results are: $V_S$=+285 V, $\Delta V_D$=4.3 V/s, $\Delta V_{Ph}$=115 V/s and E=3.3 V/lx s.

EXAMPLE 20-31

These Examples are listed in Table 3. They are carried out by procedures analogous to those of Examples 18 and 19.

Table 3

| Example | Black pigment | | $V_S$ (V) | $\Delta V_D$ (V/s) | $\Delta V_{Ph}$ (V/s) | E (V/lx s) |
|---|---|---|---|---|---|---|
| 20 | of the formula (IV), | B = $CH_3$ | − 340 | 4.0 | 215 | 6.1 |
| 21 | " | " | + 345 | 4.3 | 199 | 5.7 |
| 22 | " | "* | − 215 | 3.6 | 123 | 3.5 |
| 23 | " | "* | + 250 | 3.0 | 138 | 3.9 |
| 24 | of the formula (IV), | B = $CH_2OH$ | − 525 | 4.0 | 169 | 4.8 |
| 25 | " | " | + 480 | 4.0 | 138 | 3.9 |
| 26 | of the formula (IV), | B = $C_6H_5$ | − 310 | 3.6 | 169 | 4.8 |
| 27 | " | " | + 330 | 3.6 | 162 | 4.7 |
| 28 | of the formula (V) | | − 335 | 3.0 | 169 | 4.8 |
| 29 | " | | + 363 | 4.2 | 227 | 6.5 |
| 30 | of the formula (VI) | | − 325 | 2.8 | 143 | 4.1 |
| 31 | " | | + 340 | 4.0 | 104 | 3.0 |

*with 1 part of pigment to only 5 parts of polyvinylcarbazole (in 60 parts of chlorobenzene)

EXAMPLE 32

A suspension consisting of 1 part of the pigment of the formula (IV), in which B is $CH_3$, in a solution of 6 parts of Vinylite VYNS (a copolymer of vinyl chloride and vinyl acetate, available from Union Carbide) in 43 parts of methyl isobutyl ketone is ground in a laboratory sand mill until a fine state of division is attained. An aluminium sheet is coated with the resulting suspension using a film drawing rod (wet film thickness about 30 micrometers).

The measurement of the characteristic values is made as described in Example 18. The following values are obtained with negative charging: $V_S=-265$ V, $\Delta V_D=3.0$ V/s, $\Delta V_{Ph}=71$ V/s and E=2.0 V/lx s.

EXAMPLE 33

The recording material of Example 32 is positively charged. The following results are obtained: $V_S=+300$ V, $\Delta V_D=3.0$ V/s, $\Delta V_{Ph}=55$ V/s, E=1.6 V/lx s.

EXAMPLES 34–39

Examples 34 to 39 are carried out by procedures analogous to those of Examples 32 and 33, but with other pigments and partly with another film thickness. The results are reported in Table 4.

Table 4

| Example | Black pigment of the formula | Wet film thickness (micrometers) | $V_S$ (V) | $\Delta V_D$ (V/s) | $\Delta V_{Ph}$ (V/s) | E (V/lx s) |
|---|---|---|---|---|---|---|
| 34 | (V) | 60 | − 520 | 3.8 | 352 | 10.1 |
| 35 | " | " | + 600 | 5.5 | 214 | 6.1 |
| 36 | (VI) | 30 | − 310 | 3.8 | 58 | 1.7 |
| 37 | " | " | + 310 | 4.0 | 37 | 1.0 |
| 38 | (IV),B = $C_6H_5$ | 30 | − 218 | 2.8 | 49 | 1.4 |
| 39 | " | " | + 255 | 3.3 | 51 | 1.5 |

EXAMPLES 40–45

In these Examples the pigment of the formula (IV), in which B=$CH_2OH$, and the binder Vinylite VYNS are used. The ratio of pigment/binder is varied as follows: Examples 40 and 41 proceed in a manner analogous to that of Examples 32 and 33 with a ratio of 1:6. In Examples 42 and 43, 2.5 parts of binder in 43 parts of methyl isobutyl ketone are used to 1 part of pigment. In Examples 44 and 45, 1 part of binder in 14.7 parts of methyl isobutyl ketone are used to 1 part of pigment.

The results are reported in Table 5.

Table 5

| Example | Ratio of pigment/ Vinylite VYNS | $V_S$ (V) | $\Delta V_D$ (V/s) | $\Delta V_{Ph}$ (V/s) | E (V/lx s) |
|---|---|---|---|---|---|
| 40 | 1 / 6 | −255 | 2.0 | 153 | 4.4 |
| 41 | 1 / 6 | +285 | 2.8 | 129 | 3.7 |
| 42 | 1 / 2.5 | −230 | 3.0 | 147 | 4.2 |
| 43 | 1 / 2.5 | +220 | 1.0 | 92 | 2.6 |
| 44 | 1 / 1 | −190 | 6.0 | 332 | 9.2 |
| 45 | 1 / 1 | +180 | 3.4 | 163 | 4.7 |

EXAMPLES 46–48

Examples 30, 34 and 44 are repeated, but with the difference that the exposure is carried out through different filters of the "Dyntest-90" measuring device instead of with white light. The results are reported in Table 6.

Table 6

| Filter | Values of $\Delta V_{Ph}$ (V/s) Example 46 (as Example 30) | Example 47 (as Example 34) | Example 48 (as Example 44) |
|---|---|---|---|
| yellow | 92 | 460 | 221 |

Table 6-continued

| Filter | Values of $\Delta V_{Ph}$ (V/s) Example 46 (as Example 30) | Example 47 (as Example 34) | Example 48 (as Example 44) |
|---|---|---|---|
| red | 77 | 598 | 221 |
| green | 46 | 77 | 92 |
| cyan | 46 | 92 | 113 |

EXAMPLE 49–53

The layers as prepared in Examples 13 to 17 are tested with the "Dyntest-90" measuring device as in Examples 18 to 45. These layers are also suitable for use as electrophotographic recording materials as the results of Table 7 show.

Table 7

| Example | Black pigment | $V_S$ (V) | $\Delta V_D$ (V/s) | $\Delta V_{Ph}$ (V/s) | E (V/lx s) |
|---|---|---|---|---|---|
| 49 | of the formula (V) | −210 | 4 | 92 | 2.6 |
| 50 | of the formula (VI) | −210 | 2 | 138 | 3.9 |
| 51 | of the formula (IV),B=$CH_3$ | −240 | 6 | 86 | 2.5 |
| 52 | of the formula (IV),B=$CH_2OH$ | −570 | 8 | 582 | 16.6 |
| 53 | of the formula (IV),B=$C_6H_5$ | −245 | 4 | 300 | 8.6 |

What is claimed is:

1. An electrophotographic imaging process comprising the imagewise separation of electrically photosensitive particles by the combined action of an electric field and an imagewise irradiation with electromagnetic radiation, said particles being dispersed in an isolation medium, said particles containing a black pigment which is both chromophoric and electrically photosensitive, wherein the black pigment is selected from the metal complexes of the formula

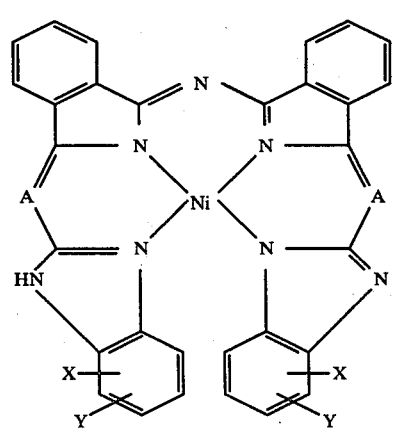

wherein

A represents a nitrogen atom or the

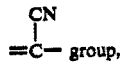

X represents a hydrogen or halogen atom or an alkyl group of 1 to 6 carbon atoms, Y represents a hydrogen or halogen atom, an alkyl, alkoxy or alkylsulphonyl group of 1 to 6 carbon atoms, a nitro or carbamoyl group, an alkylcarbamoyl or alkoxycarbonyl group of 2 to 6 carbon atoms or an arylcarbamoyl or aryloxycarbonyl of 7 to 11 carbon atoms.

2. A process as claimed in claim 1 wherein a nickel complex of the formula

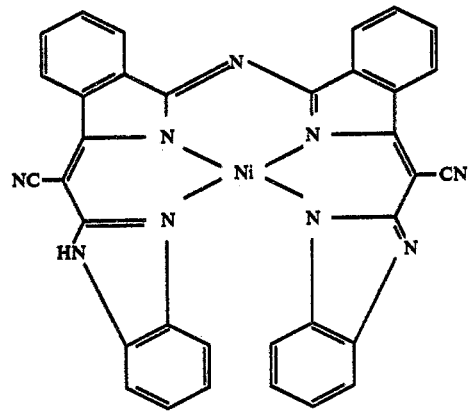

is used as metal complex.

3. A process as claimed in claim 1 wherein a nickel complex of the formula

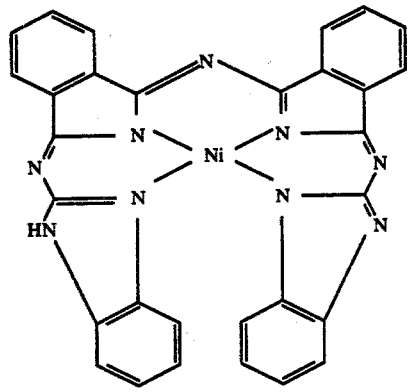

is used as metal complex.

4. An electrophotographic recording material which contains as electrically photosensitive component a black pigment according to claim 1.

* * * * *

UNITED STATES PATENT AND TRADEMARK OFFICE

CERTIFICATE OF CORRECTION

PATENT NO. : 4,191,566

DATED : March 4, 1980

INVENTOR(S) : Remy Jeanneret

It is certified that error appears in the above—identified patent and that said Letters Patent is hereby corrected as shown below:

On the title page, item (73) Assignee should be deleted in its entirety.

Signed and Sealed this

*Eighth* Day of *July 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,191,566

DATED : March 4, 1980

INVENTOR(S) : REMY JEANNERET ET AL

It is certified that error appears in the above—identified patent and that said Letters Patent is hereby corrected as shown below:

On the title page item [73] assignee should be

-- CIBA-GEIGY AG, Basle, Switzerland --

This certificate supersedes Certificate of Correction issued July 8, 1980.

Signed and Sealed this

*Eighth* Day of *June 1982*

[SEAL]

*Attest:*

GERALD J. MOSSINGHOFF

*Attesting Officer*

*Commissioner of Patents and Trademarks*